US006579190B2

(12) United States Patent
Yamamoto

(10) Patent No.: US 6,579,190 B2
(45) Date of Patent: Jun. 17, 2003

(54) BALL MOTION MEASURING APPARATUS

(75) Inventor: Akio Yamamoto, Hyogo (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 42 days.

(21) Appl. No.: 09/805,981

(22) Filed: Mar. 15, 2001

(65) Prior Publication Data

US 2001/0023209 A1 Sep. 20, 2001

(30) Foreign Application Priority Data

Mar. 15, 2000 (JP) ..... 2000-072200

(51) Int. Cl.[7] ..... A63B 53/00

(52) U.S. Cl. ..... 473/141; 473/156; 473/405; 473/406; 473/407; 473/199

(58) Field of Search ..... 473/199, 465, 473/407, 156, 140–141; 73/649

(56) References Cited

U.S. PATENT DOCUMENTS

| | | | | | |
|---|---|---|---|---|---|
| 5,111,410 | A | * | 5/1992 | Nakayama et al. | 364/551.01 |
| 5,471,383 | A | | 11/1995 | Gobush et al. | 364/410 |
| 5,575,719 | A | * | 11/1996 | Gobush et al. | 473/223 |
| 5,792,000 | A | * | 8/1998 | Weber et al. | 473/223 |
| 5,803,823 | A | * | 9/1998 | Gobush et al. | 473/223 |
| 5,906,547 | A | * | 5/1999 | Tynan | 473/199 |
| 5,926,780 | A | * | 7/1999 | Fox et al. | 702/142 |
| 6,041,651 | A | * | 3/2000 | Naruo et al. | 73/491 |
| 6,042,483 | A | * | 3/2000 | Katayama | 473/199 |
| 6,192,323 | B1 | * | 2/2001 | Boehm | 702/182 |
| 6,286,364 | B1 | * | 9/2001 | Aoyama et al. | 73/65.03 |

FOREIGN PATENT DOCUMENTS

| | | |
|---|---|---|
| JP | 3-210282 A | 9/1991 |
| JP | 07-286837 | 10/1995 |
| JP | 8-278169 A | 10/1996 |
| JP | 10-186474 A | 7/1998 |
| JP | 2879881 B2 | 1/1999 |
| JP | 2950450 B2 | 7/1999 |

* cited by examiner

*Primary Examiner*—Valencia Martin-Wallace
*Assistant Examiner*—Carmen D. White
(74) *Attorney, Agent, or Firm*—Birch, Stewart, Kolasch & Birch, LLP

(57) ABSTRACT

A ball motion measuring apparatus has a CCD camera having a multi-shutter which can open and close successively; strobes; a swinging speed measuring sensor; and a controlling/computing device connected to the CCD camera, the strobes, and the swinging speed measuring sensor. The swinging speed measuring sensor outputs a trigger signal for opening/closing the shutter to the CCD camera when the swinging speed measuring sensor detects passage of a golf club. Upon receipt of the trigger signal, the multi-shutter opens and closes successively. Synchronously with the opening/closing of the multi-shutter, the strobes emit flashlight sequentially. In this manner, a plurality of images of a golf ball driven by the golf club are photographed in a one-image frame.

13 Claims, 11 Drawing Sheets

BALL MOTION MEASURING APPARATUS

BACKGROUND OF THE INVENTION

1. Field to the Invention

The present invention relates to a ball motion measuring apparatus. More particularly, the present invention relates to a ball motion measuring apparatus for measuring various kinds of motions of balls such as a golf ball, a baseball ball, a tennis ball, and the like after hitting.

2. Description of the Related Art

There have been provided apparatuses and methods for measuring various kinds of motions of balls such as a golf ball after hitting, namely, the speed, rotational amount, the angle of elevation, and the deflection angle thereof with respect to a predetermined flight direction.

FIG. 5 shows a method 1 of measuring a golf ball disclosed in Japanese Patent Application Laid-Open No.3-210282. In the measuring method 1, the image of the golf ball immediately after hitting is photographed by a first camera 2 disposed vertically to the golf ball and higher than the golf ball and a second camera 3 disposed horizontally or by only the first camera 2, with a strobe 4 emitting light to the golf ball.

FIG. 6A shows a method 5 of measuring a golf ball disclosed in Japanese Patent Application Laid-Open No.10-186474. In the measuring method 5, the motion of the golf ball after hitting is measured by first and second cameras 7-1 and 7-2 installed in front of a tee 6. The first and second cameras 7-1 and 7-2 photograph images 9-1 and 9-2 of the golf ball at different times by differentiating shutter opening/closing times determined by detection of a sensor 8 installed rearward from the tee 6, as shown in FIG. 6B.

In addition, in a measuring apparatus disclosed in each of Japanese Registered Patent Nos.2879881 and 2950450, two cameras are used to photograph the image of a golf ball immediately after hitting. The motion of the golf ball such as its speed, its rotational amount, and the like is computed by a controlling/computing device, based on the image of the golf ball photographed by the above-described measuring methods or apparatuses.

In the measuring method 1 shown in FIG. 5, the shutter of each camera is always open to photograph the golf ball at predetermined intervals by flashing the strobe 4 two or more times. Thus, it is necessary to reduce the degree of aperture opening of each camera to keep the shutter always open. The amount of light emitted by the strobe is insufficient outdoors because there is too much sunlight outdoors. Thus, it is difficult to obtain an image having a clear contour of the ball. Therefore, to compensate for clearness of the golf ball in analyzing the motion of the golf ball, it is necessary to put a required mark on the golf ball surface to be photographed. It is also necessary to locate the first camera 2 at a position immediately above the golf ball. Thus, much time and labor are required in preparation for measurement.

The camera 7-1 and 7-2 which are used in the measuring method 5 shown in FIG. 6A captures only one ball image into one image frame. Moreover, because the opening/closing speed of the shutter is not high enough to capture a plurality of images of the ball at a very high speed, a plurality of cameras are required to capture a plurality of ball images into the image frame at short intervals. Thus, the measuring method 5 causes the measuring apparatus to be complicated and large-scaled. Normally, the motion of the golf ball is photographed outdoors. Thus, it is important that the measuring apparatus is easy to carry. In this respect, the measuring apparatus is not easy to carry and much time and labor are required in installing each camera at a predetermined position.

The measuring apparatus with two cameras disclosed in Japanese Registered Patent Nos.2879881 and 2950450 respectively is also disadvantageous because they have the same problem as that of the measuring method 5. In addition, they require the use of a golf ball on which a reflective dot pattern has been put to compensate for clearness of the image of the ball. In the Registered Patent No.2879881, there is also disclosed that the apparatus can photograph a ball image by only one camera. But a ball image photographed by one camera is incapable of measuring a deflection angle.

SUMMARY OF THE INVENTION

The present invention has been made in view of the above-described problem. Accordingly, it is an object of the present invention to provide a ball motion measuring apparatus capable of photographing a ball image with one CCD camera having a multi-shutter, analyzing various motions of a hit ball with high accuracy, easy to carry, and compact.

To solve the problem, there is provided A ball motion measuring apparatus comprising a CCD camera having a multi-shutter capable of successively opening and closing at a plurality of times at a high speed; a triggering sensor detecting a movement of a ball-hitting means or that of a ball and outputting a trigger signal to set opening/closing times of said multi-shutter; and a controlling/computing device connected to said CCD camera and said triggering sensor and having a storing medium for an image frame and an image display means.

Owing to a plurality of successive openings/closings of said multi-shutter caused by detection of said triggering sensor, said CCD camera photographs a plurality of ball images on a one-image frame, and said image display means displays said ball images in said one-image frame.

The conventional shutter-provided CCD camera can capture only one image into the one-image frame. Thus, it is necessary to prepare a plurality of cameras to photograph a plurality of ball images. According to the present invention, it is possible to photograph a plurality of ball images by using one multi-shutter-provided CCD camera. That is, the multi-shutter can successively open and close at a plurality of times at intervals as short as 1.5 ms to 3.0 ms. Therefore, the CCD camera can capture a plurality of ball images into the one-image frame and the ball images can be displayed on a monitor at same time. Because one CCD camera photographs the ball images, it is possible to make the entire measuring apparatus compact and lightweight. Thus, it is possible to reduce time and labor required to carry the component parts of the measuring apparatus and install the camera at a predetermined position.

The multi-shutter is initially opened and closed in association with a trigger signal of the triggering sensor detecting the passage of the ball and so on. Therefore, it is possible to prevent the shutter opening/closing time from being unsynchronous with the passage of the ball and capture the ball image reliably and automatically. As the triggering sensor, it is possible to use a sensor detecting passage of a ball-hitting means, a reflective-type sensor detecting passage of a hit ball, a sound sensor detecting a hitting sound, and the like. A plurality of ball images captured in the one-image frame are sent to the controlling/computing device connected to the CCD camera. Upon receipt of the ball images, the controlling/computing device computes motions of the ball with high accuracy.

According to the present invention, strobes whose number is equal to or more than the number of opening/closing times of said multi-shutter are connected to said controlling/computing device, and said strobes flash sequentially and synchronously with opening/closing times of said multi-shutter. Because a plurality of strobes flash sequentially and synchronously with opening/closing times of said multi-shutter, a ball can be photographed with only the ball irradiated with flashlight owing to a high speed opening/closing of the multi-shutter. Thus, it is possible to prevent capturing of light emitted from objects such as a background other than an object to be photographed and obtain a ball image having a clear contour. Accordingly, it is possible to photograph a ball image clearly and securely when the ball is photographed outdoors although a large amount of light is present there. To irradiate the ball with a sufficient amount of light, it is possible to provide strobes whose number is twice as large as that of the multi-shutter or more and flash a plurality of strobes simultaneously and synchronously with the opening/closing of the multi-shutter.

Because the ball image is photographed with the ball irradiated with flashlight, the contour of the ball is clear and the surface of the ball is photographed clearly. Thus, indication of a brand put on the surface of the ball can be clearly checked. Further, it is possible to measure motions of the ball such as its rotational amount, speed, angle of elevation, and the like with high accuracy without applying a mark to the surface of the ball to be measured. Needless to say, a mark-applied ball can be used to measure its motion as conventionally done.

According to the present invention, said controlling/computing device is connected to a swinging speed measuring sensor, for measuring a swinging speed of said ball-hitting means, having a projector having two projecting parts each emitting a detection ray and a receptor having two light-receiving parts each detecting said detection rays, and said swinging speed measuring sensor is disposed rearward from a ball-hitting position so that said controlling/computing devices measures an interval between a time when said ball-hitting means intercepts one of said detection rays and a time when said ball-hitting means intercepts the other detection ray. Thereby a swinging speed of ball-hitting means is computed. By the swinging speed measuring sensor detecting the swinging speed of the ball-hitting means, the controlling/computing device can compute the swinging speed of the ball-hitting means in addition to motions of the hit ball. Thus, the ball motion measuring apparatus can be utilized to make a composite analysis having the characteristic of the ball. The interval between the two projecting parts is known. Thus, by measuring the interval between the time when said ball-hitting means intercepts one of said detection rays and the time when said ball-hitting means intercepts the other detection ray, it is easy to determine the passage speed of the ball-hitting means.

The swinging speed measuring sensor serving as said triggering sensor is horizontally located at a position, 20 mm to 40 mm rearward from said ball-hitting position, orthogonal to an imaginary straight line extending in a predetermined progress direction of said ball and outputting said trigger signal when said ball-hitting means intercepts said detection rays. The CCD camera is horizontally located at a position, 100 mm to 300 mm forward from said ball-hitting position, orthogonal to said imaginary straight line to photograph images of said ball immediately after hitting.

By using the swinging speed measuring sensor as the triggering sensor, it is unnecessary to provide the ball motion measuring apparatus with the triggering sensor separately from the swinging speed measuring sensor. Thus, it is possible to simplify the construction of the ball motion measuring apparatus applicable to various measurements, and thus the swinging speed measuring sensor is easy to carry. The analysis of the motion of the ball immediately after hitting is very important in judging the ball performance and the characteristic performance of the ball-hitting means. In this respect, it is necessary that the image of the ball is clear to make correct judgement. Accordingly, by disposing the swinging speed measuring sensor serving as said triggering sensor in the above-described range and disposing the CCD camera at the above-described position, the image of the ball immediately after hitting can be securely captured. Consequently, a correct judgement can be made on the ball performance and the characteristic performance and of the ball-hitting means.

Based on a plurality of images of a ball photographed in said one-image frame, said controlling/computing device determines a central coordinate of each of images of said ball and computes an actual movement distance of said ball and a flight speed of said ball from an interval between an opening/closing time of said multi-shutter and a successive opening/closing time of that. Owing to the pre-calibration of the CCD camera, the controlling/computing device of the present invention can make the movement amount of the ball image in the image frame and the actual movement of the ball relative to each other from the images of the ball captured into the one-image frame. Based on the determined actual movement distance of the golf ball and the shutter opening interval corresponding to the time period required for the ball to travel the actual movement distance, the controlling/computing device determines the flight speed of the ball.

According to the present invention, based on a plurality of images of a ball photographed in said one-image frame, said controlling/computing device computes an angle of a trajectory passing through central coordinates of images of said ball with respect to a horizontal direction pre-calibrated on said one-image frame to compute a flight angle of said ball with respect to an actual horizontal line. Because the horizontal calibration made on the image frame allows the relationship between the trajectory of the ball and the horizontal direction to be easily analyzed. Thus, the angle of elevation can be easily computed.

Further, according to the present invention, said controlling/computing device compares a diameter of each of a plurality of images of a measuring ball in said one-image frame with a diameter of each of reference images of two or more balls pre-photographed by said CCD camera, which stored in said controlling/computing device adding each data of said balls locating at different positions with respect to said imaginary straight line extending in said predetermined progress direction of said balls to determine a distance from said imaginary straight line and compute a deflection angle of said measuring ball with respect to said predetermined progress direction.

The controlling/computing device compares the diameter of the photographed measuring ball images with the diameter of the photographed reference ball images. In this case, owing to positional data of the photographed reference ball image, it is possible to grasp the positional relationship between the photographed measuring ball images and the imaginary straight line. Thus, only one CCD camera allows the deflection angle of the measuring ball to be computed.

According to the present invention, the reference ball image is obtained by photographing a ball located at two or more positions of a straight line passing the CCD camera at a right angle with the imaginary straight line. For example, the controlling/computing device stores the data of a ball photographed at a position located at the side of the CCD camera with respect to the imaginary straight line and the data of a ball photographed at a position located at the side opposite to the side of the CCD camera with respect to the imaginary straight line. The controlling/computing device may store data of more reference ball images by photographing a ball at two or more positions.

Further, according to the present invention, based on a plurality of images of a ball photographed in said one-image frame, said controlling/computing device determines a central coordinate of each of a plurality of images of said ball and computes an actual movement distance of a given point on said ball to compute a rotational amount of said ball on a rotational axis passing through a central coordinate of said ball by an interval between an opening/closing time of said multi-shutter and a successive opening/closing time of that. The rotational amount of the ball is important in judging its characteristic and thus essentially measured. In the ball motion measuring apparatus, flashlight is emitted by strobes synchronously with opening/closing time of the shutter. Therefore, the situation of the surface of the ball can be clearly captured and the rotational amount of the ball can be easily computed.

That is, an indication or a pattern showing a brand or the like is put on the surface of the ball. The indication or the pattern can be confirmed on a photographed ball image. Therefore, it is easy to compute the rotational amount of the ball with respect to its rotational axis from a movement situation of the indication or the like on each ball image. According to the ball motion measuring apparatus of the present invention, not only the surface of the ball image but also the contour thereof can be photographed clearly. Thus, it is unnecessary to use a ball on which a particular measuring mark has been put on the golf ball unlike the conventional ball motion measuring apparatus. Thus, much time and labor are not required in preparation for measurement of the motion of the ball, which allows the measurement to be easily accomplished. Needless to say, the ball motion measuring apparatus of the present invention is applicable to measurement of the motion of a golf ball on which a mark has been put, similarly to the conventional measuring apparatus.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE PREFERRED EMBODIMENTS

The embodiments of the present invention will be described below with reference to the drawings.

Figure 1:
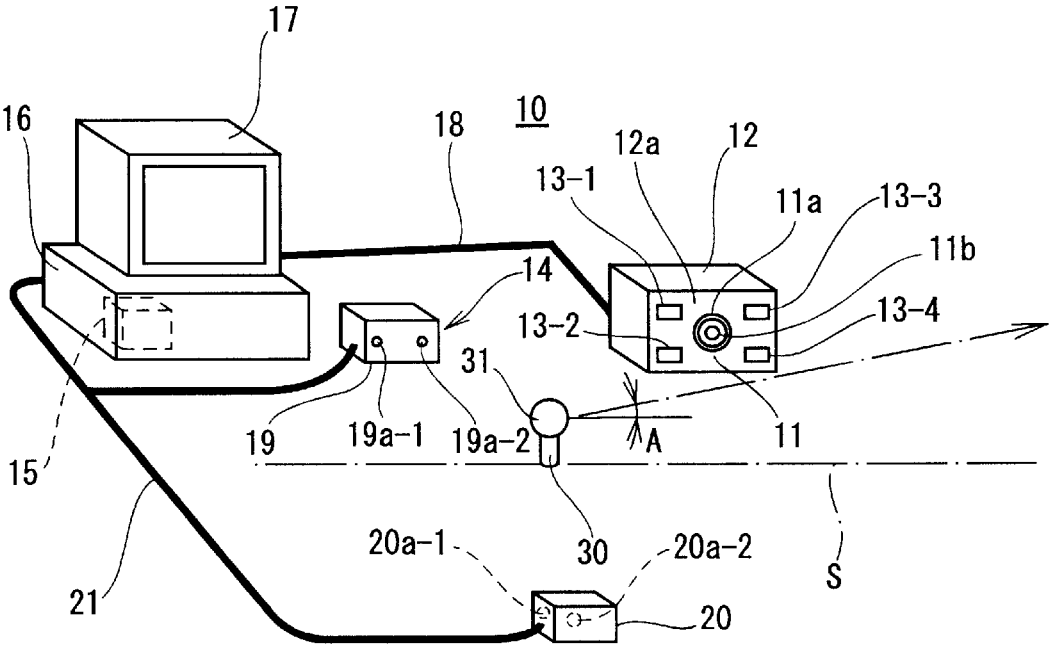
FIG. 1 is a schematic view showing a ball motion measuring apparatus according to the present invention.

FIG. 1 shows a ball motion measuring apparatus 10 for measuring the motion of a ball. The ball motion measuring apparatus 10 has a CCD camera 11 having a lens ha and a multi-shutter 11*b;* strobes 13-1–13-4; a swinging speed measuring sensor 14; and a controlling/computing device 16 having a storing medium 15 for an image frame (hereinafter referred to as merely storing medium 15) and connected to a monitor 17 serving as an image display means.

The CCD camera 11 accommodates the multi-shutter 11*b* which can open and close successively at a plurality of times to photograph an object by the function of the multi-shutter 11*b*. The multi-shutter 11*b* has a high shutter opening/closing speed of $1/10000$ seconds to $1/20000$ seconds at intervals as short as 1.5 ms to 3.0 ms. Owing to the multi-shutter 11*b* having the very high shutter speed, the CCD camera 11 catches only a ball irradiated with the strobes and does not capture light emitted from a background or the like.

Owing to the multi-shutter 11*b* opening and closing successively at a high speed, a plurality of images can be captured into a one-image frame of the CCD camera 11. That is, because the multi-shutter 11*b* opens and closes successively at a high speed, a plurality of the images of a hit ball are captured into the one-image frame of the CCD camera 11 for every opening/closing of the multi-shutter 11*b*. That is, the one-image frame of the CCD camera 11 stores data of a plurality of the images of the ball. The opening/closing speed of the shutter and the shutter opening/closing interval are appropriately set in the above-described range in consideration of a photographing situation and condition.

The CCD camera 11 is connected to the controlling/computing device 16 through a connection line 18. The data of the image photographed as described above is fed to the controlling/computing device 16, stored by the storing medium 15 accommodated in the controlling/computing device 16, and can be displayed on the monitor 17.

A housing 12 accommodates the strobes 13-1–13-4 and the CCD camera 11. The strobes 13-1–13-4 are connected to the controlling/computing device 16 through a strobe line included in the connection line 18. In the embodiment, as will be described in detail later, the multi-shutter 11*b* opens and closes two times successively to capture two ball images into the one-image frame. To do so, the ball motion measuring apparatus 10 has four strobes 13-1–13-4 twice as large as the number of shutter opening/closing times.

Figure 2A:
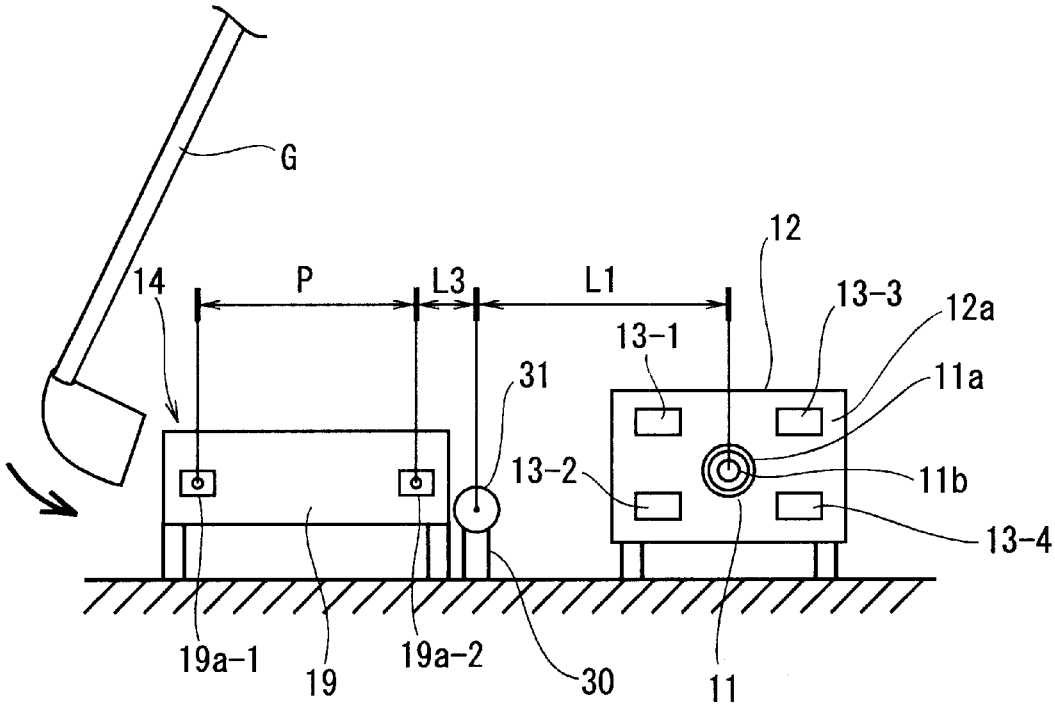
FIG. 2A is a side view showing a situation of disposition of a CCD camera of the ball motion measuring apparatus and a swinging speed measuring sensor thereof seen from a lateral side.

More specifically, as shown in FIGS. 1 and 2A, the first strobe 13-1 and the second strobe 13-2 are located at upper and lower positions of a front surface 12*a* of the housing 12, respectively in a hitting-position side with respect to the lens 11*a,* while the third strobe 13-3 and the fourth strobe 13-4 are located at upper and lower positions of front surface 12*a* of the housing 12, respectively in the side opposite to the hitting-position side. The first strobe 13-1 and the second strobe 13-2 emit light synchronously with a first opening/closing of the multi-shutter 11*b,* whereas the third strobe 13-3 and the fourth strobe 13-4 emit light synchronously with a second opening/closing of the multi-shutter 11*b*. That is, to obtain a clear ball image, only the hit ball is irradiated with a sufficient amount of light emitted by the two strobes when the shutter opens.

The flashing time period of each of the strobes 13-1–13-4 is set to the range of two microseconds to five microseconds. The flashing interval is set in association with the opening/closing speed of the shutter of the multi-shutter 11*b* and the shutter opening/closing interval. The number of the strobes is not limited to four, but may be appropriately increased or decreased in consideration of an object to be photographed and a photographing environment. For example, only one strobe may be flashed or three strobes may be flashed simultaneously to secure a sufficient of light. The strobes may be provided separately from the housing 12 accommodating the CCD camera 11.

The swinging speed measuring sensor 14 has a pair of projectors 19 and a pair of receptors 20. As shown in FIG. 2A, each projector 19 has two projecting parts 19*a*-1 and 19*a*-2 spaced at an interval P and irradiating detection rays such as infrared rays. The interval P can be set appropriately in the range of 50 mm to 150 mm. The receptor 20 has two light-receiving parts 20*a*-1 and 20*a*-2 detecting the detection rays irradiated from the projecting parts 19*a*-1 and 19*a*-2 respectively. The interval between the light-receiving parts 20*a*-1 and 20*a*-2 is set equally to the interval P.

The swinging speed measuring sensor 14 serves as a triggering sensor outputting a trigger signal determining the time of the multi-shutter 11*b* to open and close. The swinging speed measuring sensor 14 is connected to the controlling/computing device 16 through a connection line 21. The swinging speed measuring sensor 14 sends the trigger signal to the controlling/computing device 16 simultaneously with the time when the detection rays emitted by the projector 19 are intercepted with a golf club or the like and the receptor 20 cannot detect them. In this manner, the opening/closing timing of the multi-shutter 11*b* is set.

The controlling/computing device 16 controls input and output signals and computes image data inputted thereto. The controlling/computing device 16 houses a controlling/computing portion and a data-storing portion in addition to the storing medium 15. Data of the disposition of the CCD camera 11 and the swinging speed measuring sensor 14 and an expected speed of the ball is inputted to the controlling/computing device 16 before measuring. The controlling/computing device 16 also stores a large number of reference ball images to be used as the reference for comparison. Upon receipt of the trigger signal outputted from the swinging speed measuring sensor 14 owing to the interception of the detection rays, based on the various data, the controlling/computing device 16 outputs a shutter opening/closing signal to the multi-shutter 11*b* of the CCD camera 11 at a time when the ball is expected to pass the CCD camera 11. In this manner, the CCD camera 11 can take a photograph of the image of the ball securely.

The controlling/computing portion (not shown) accommodated in the controlling/computing device 16 computes the motion of the photographed ball by analyzing the data of the ball image. To do so, the controlling/computing portion performs computations of comparing image data stored in the storing medium 15 and internal data stored in the controlling/computing portion with each other. In this manner, the controlling/computing portion computes a speed, an angle of elevation, and the like of the photographed ball. The monitor 17 displays the results of the computation.

The method of photographing the image of a golf ball and computing the motion thereof is carried out by the ball motion measuring apparatus 10 will be described below by exemplifying a golf ball immediately after hitting.

Figure 2B:
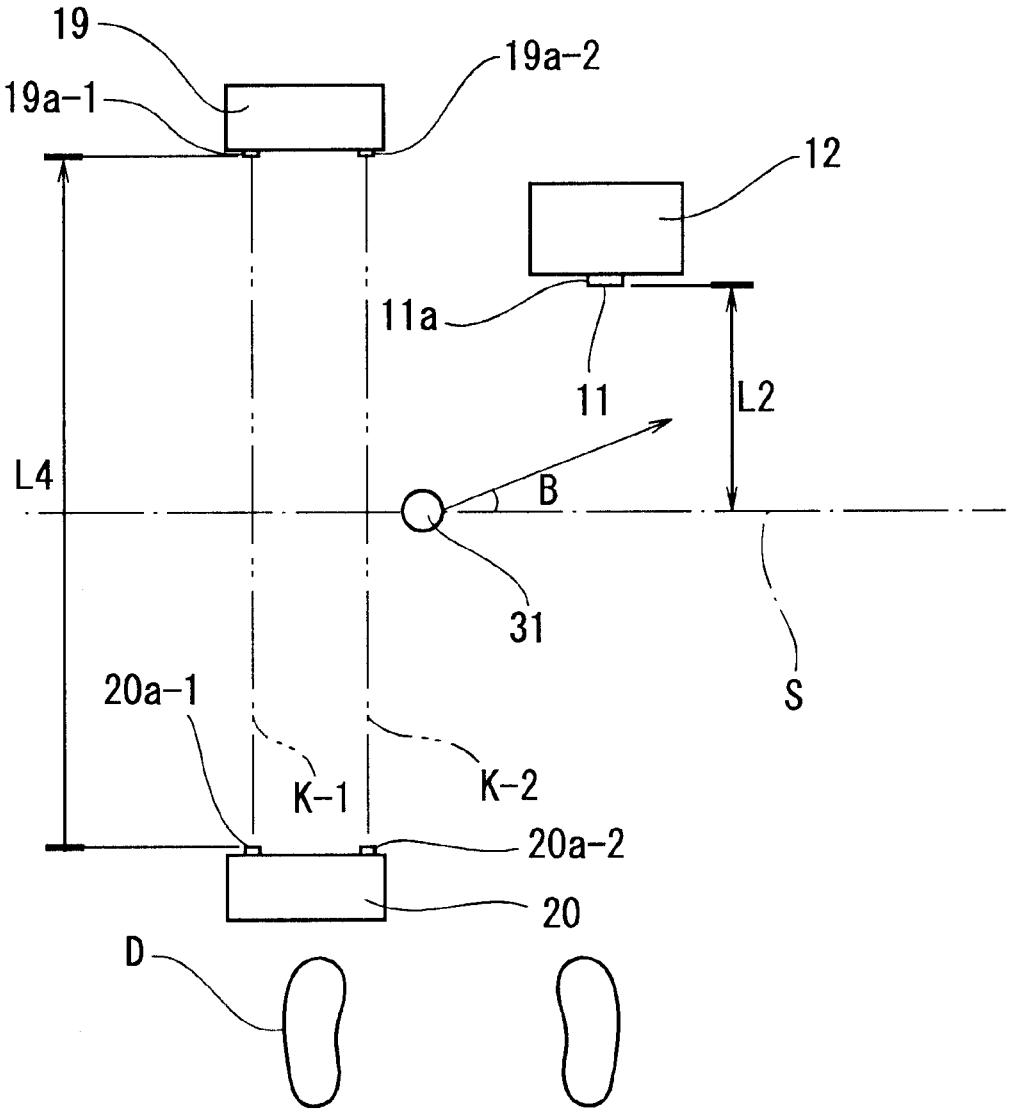
FIG. 2B is a plan view showing a situation of disposition of the CCD camera of the ball motion measuring apparatus and the swinging speed measuring sensor thereof.

Initially, before measuring, as shown in FIGS. 1 and 2A and 2B, the CCD camera 11 and the swinging speed measuring sensor 14 are arranged at a position respectively suitable for making the measurement of the golf ball immediately after hitting.

The CCD camera 11 is located at a position, forward from a tee 30 at which a golf ball 31 is hit, at which the flight direction of the golf ball 31 can be caught laterally. More specifically, the CCD camera 11 is horizontally located at a position allowing a forward distance L1 from the tee 30 to the center of the lens 11*a* of the CCD camera 11 to be in the range of 100 mm to 300 mm and also allowing an orthogonal distance L2 from the lens 11*a* to an imaginary predetermined progress line S extending in a predetermined progress direction of the golf ball 31 and connecting the tee 30 and a target position to each other to be in the range of 150 mm to 300 mm. In the embodiment, the forward distance L1 is set to 120 mm, and the orthogonal distance L2 is set to 200 mm.

The swinging speed measuring sensor 14 is located at a position, rearward from the tee 30, at which the projector 19 and the receptor 20 confront each other, with the predetermined progress line S interposed therebetween being orthogonal to the line connecting the projector 19 and the receptor 20 to each other. More specifically, the swinging speed measuring sensor 14 is horizontally located at a position allowing a rearward distance L3 from the tee 30 to the intersection of the imaginary predetermined progress line S and a straight line connecting the second projecting part 19*a*-2 of the projector 19 and the second light-receiving part 20*a*-2 of the receptor 20 to each other to be in the range of 20 mm to 40 mm and also allowing a separation distance L4 between the projector 19 and the receptor 20 to be in the range of 500 to 1000 mm. In the embodiment, the rearward distance L3 is set to 30 mm, the separation distance L4 is set to 700 mm, and the interval P between the first projecting part 19*a*-1 and the second projecting part 19*a*-2 is set to 100 mm.

After the CCD camera 11 and the swinging speed measuring sensor 14 are each set at the above-described position, the numerical data of disposition of the CCD camera 11 and the swinging speed measuring sensor 14, the data of the number of times of successive opening/closing of the shutter, and other data are inputted to the controlling/computing device 16. In addition, the data of the reference ball images with respect to the predetermined progress line S is stored in the controlling/computing device 16.

After the CCD camera 11 is set in the state in which it can take a photograph, as shown in FIG. 2B, the swinging speed measuring sensor 14 is set in the state in which the detection rays K-1 and K-2 can be projected from the first projecting part 19*a*-1 of the projector 19 and the second projecting part 19*a*-2 thereof respectively to the receptor 20.

In this state, the golf ball 31 on which a brand or the like has been marked is placed on the tee 30. Then, a hitting person or a hitting machine located at a hitting position D swings a golf club G. When the golf club G passes between the projector 19 and the receptor 20, it intercepts the detection rays K-1 and K-2 instantaneously and hits the golf ball 31 from the tee 30.

When the swinging speed measuring sensor 14 detects the interception of the detection rays K-1 and K-2, the swinging speed measuring sensor 14 transmits a trigger signal for the multi-shutter to the controlling/computing device 16. Upon receipt of the trigger signal for the multi-shutter, in consideration of numerical values such as the rearward distance L3 and the forward distance L1, the controlling/computing device 16 sends a shutter opening/closing signal to the CCD camera 11 at a timing when the hit golf ball 31 passes the CCD camera 11.

Upon receipt of the shutter opening/closing signal, the multi-shutter 11*b* opens and closes initially. Synchronously with the first opening/closing of the multi-shutter 11*b*, the CCD camera 11 captures a first image of the golf ball 31 irradiated with flashlight emitted by the first and second strobes 13-1 and 13-2 into an image frame. Then, synchronously with a second opening/closing of the multi-shutter 11*b* at a predetermined interval after the first opening/closing, the CCD camera 11 captures a second image of the golf ball 31 irradiated with flashlight emitted by third and fourth strobes 13-3 and 13-4 flash into the image frame into which the first image has been captured. The interval between the time of the first opening/closing of the multi-shutter 11*b* and the time of the second opening/closing thereof is very short. Owing to a high speed successive opening/closing of the multi-shutter 11*b*, frame images 40, 50, 60, and 80 each showing a plurality of images of the golf ball 31 are stored in each one-image frame, as shown in FIGS. 3A, 3B, 3C, and 4B. The frame images 40, 50, 60, and 80 are displayed on the monitor 17.

Then, based on the frame images 40, 50, 60, and 80 of each one-image frame each showing a plurality of images of the golf ball 31, the controlling/computing device 16 computes the hit speed of the golf ball 31 immediately after the hitting, the angle of elevation, the deflection angle with respect to the predetermined progress direction of the golf ball 31, the rotational amount of the golf ball 31, and the swinging speed of the golf club.

Figure 3A:
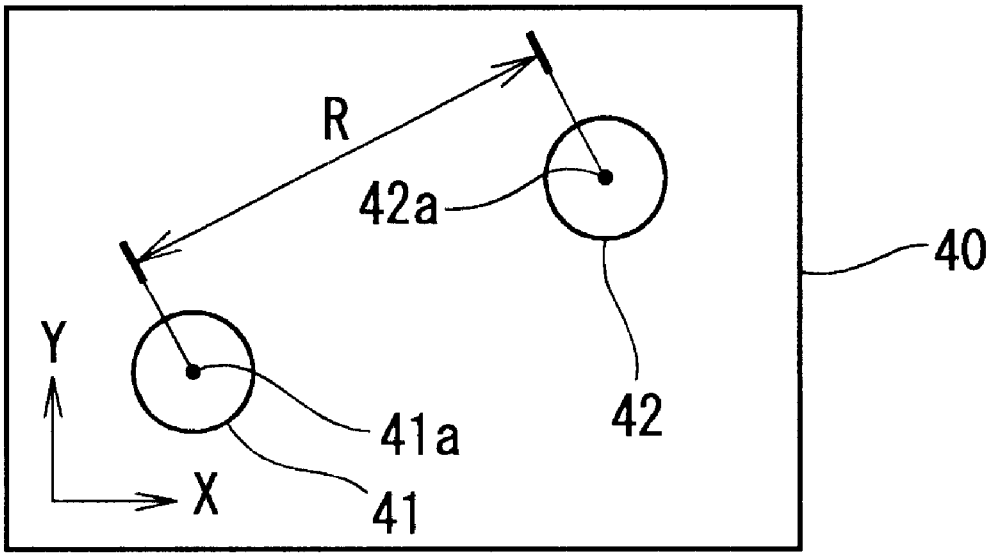
FIGS. 3A, 3B, and 3C show photographed ball images.

To compute the hit speed of the golf ball 31, namely, its flight speed, the controlling/computing device 16 analyzes the contour of the golf ball 31 clearly photographed on the frame image 40 shown in FIG. 3A. In the analyzing processing, the controlling/computing device 16 determines central coordinates 41*a* and 42*a* of first and second golf ball images 41 and 42 corresponding to an x-coordinate and a y-coordinate on the frame image 40. The controlling/computing device 16 computes a center-to-center distance R on the frame image 40 from the central coordinates 41*a* and 42*a* to correspond to the actual movement distance of the golf ball.

Then, the controlling/computing device 16 converts the determined center-to-center distance R on the frame image 40 into the actual movement distance of the golf ball, based on the orthogonal distance L2 of the CCD camera 11 and the like. The time period required for the golf ball 31 to move from the central coordinate 41*a* to the central coordinate 42*a* is equal to the interval between the first shutter opening/closing time and second shutter opening/closing time. Thus, based on the determined actual movement distance of the golf ball and the interval between the first shutter opening/closing time and second shutter opening/closing time set in the controlling/computing device 16, the controlling/computing device 16 determines the speed of the golf ball immediately after hitting.

Figure 3B:
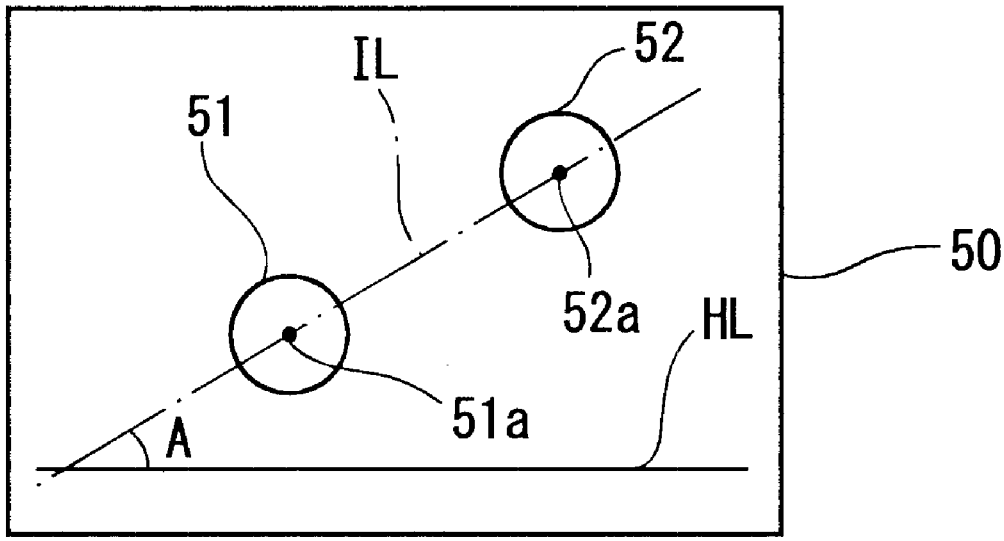

To compute the angle of elevation A which is the hitting angle with respect to a horizontal line EL shown in FIG. 1, the frame image 50 of FIG. 3B is calibrated horizontally. The controlling/computing device 16 recognizes the horizontal line HL on the frame image 50. Then, the controlling/computing device 16 determines central coordinates 51*a* and 52*a* of the first and second ball images 51 and 52, as in the case of the computation of the speed of the golf ball. Then, the controlling/computing device 16 determines a trajectory line IL passing through the central coordinates 51*a* and 52*a* to compute the angle of elevation A formed between the trajectory line IL and the horizontal line HL.

To compute the deflection angle B with respect to the predetermined progress line S shown in FIG. 2B, various reference ball images are photographed before measurement to store data of the reference ball image in the data-storing portion of the controlling/computing device 16 so that data of a ball to be measured is compared with the data of the reference ball images. It is necessary to store the data of the reference ball image by photographing the ball at two or more positions. In the embodiment, the controlling/computing device 16 stores the data a ball photographed at a position located at the side of the CCD camera 11 with respect to the predetermined progress line S and spaced at a predetermined interval from the predetermined progress line S. The controlling/computing device 16 also stores the data of the ball photographed at a position located at the side opposite to the side of the CCD camera 11 with respect to the predetermined progress line S and spaced at the predetermined interval from the predetermined progress line S. The controlling/computing device 16 also stores positional data associated with the distance from the predetermined progress line S. The data of the reference ball image to be stored by the controlling/computing device 16 is not limited to the above-described data obtained by photographing the ball at the two positions, but the controlling/computing device 16 may store data of more reference ball images by photographing the ball spaced at different distances with respect to the predetermined progress line S.

Figure 3C:
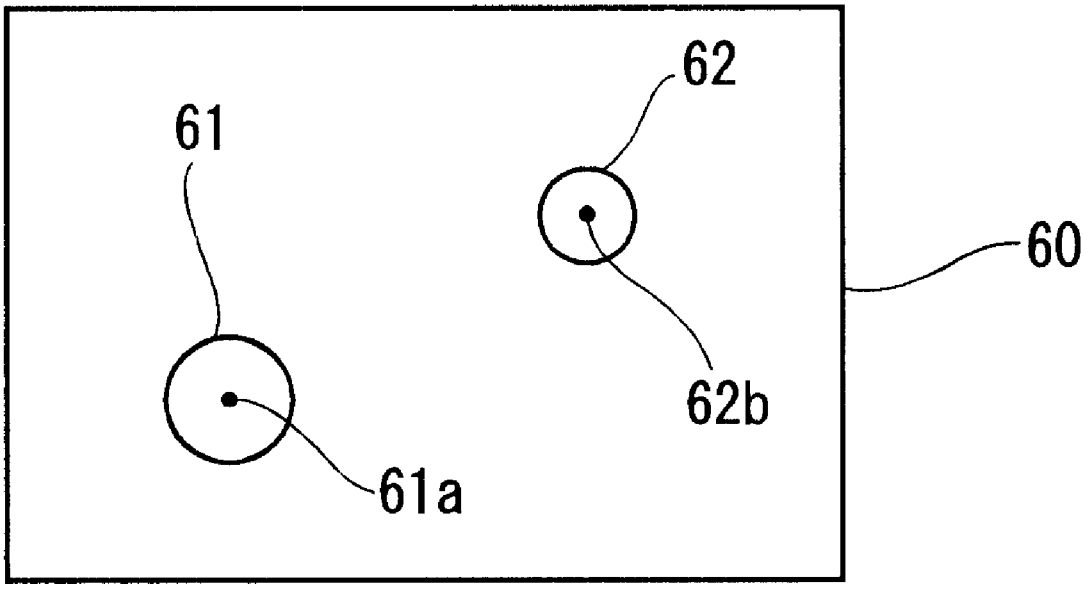

Then, the controlling/computing device 16 recognizes the outer diameter of each of first and second golf balls images 61 and 62 of the frame image 60 shown in FIG. 3C by image processing. Further, the controlling/computing device 16 compares the outer diameters of the first and second golf balls images 61 and 62 with those of the reference ball images stored in the data-storing portion. Further, the controlling/computing device 16 executes proportional computations. The controlling/computing device 16 computes the movement distance of the two ball images 61 and 62 in the deflected direction by conversion, based on the difference between the outer diameters of the two ball images 61 and 62. Based on the obtained value, controlling/computing device 16 computes the deflection angle B.

Figure 4A:
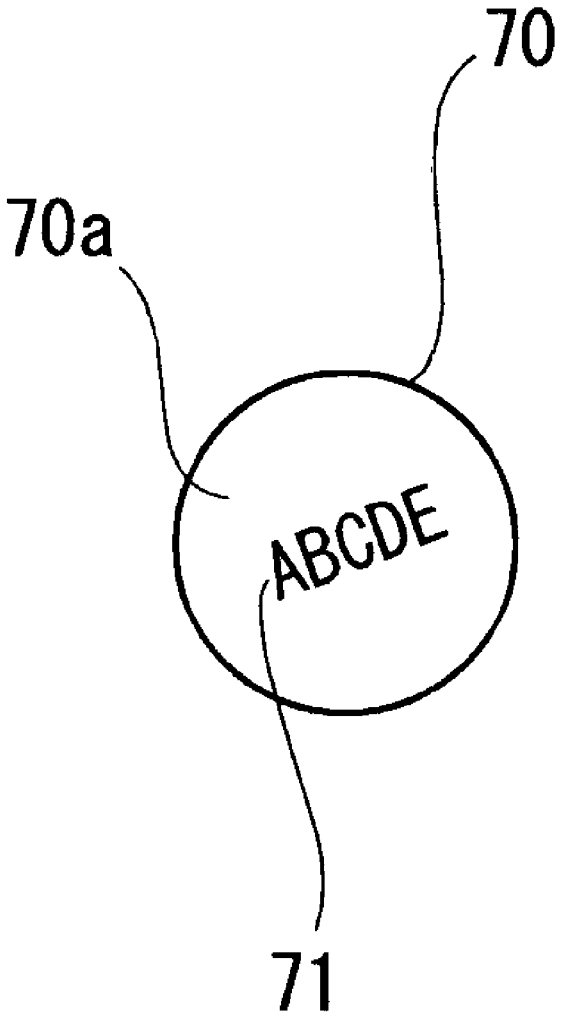
FIG. 4A shows a golf ball to be measured.
Figure 4B:
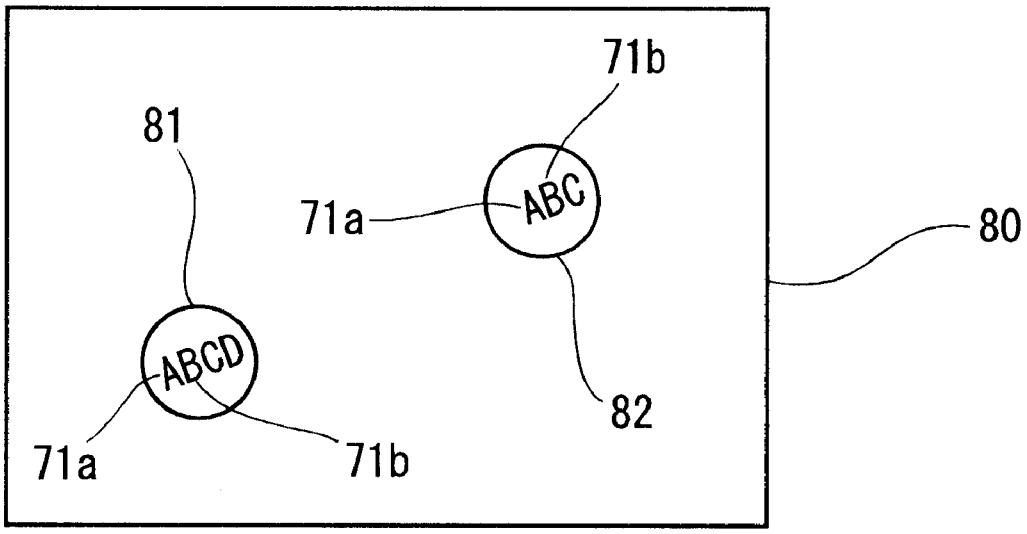
FIG. 4B shows a ball image for analyzing a rotational amount of the golf ball.
Figure 5:
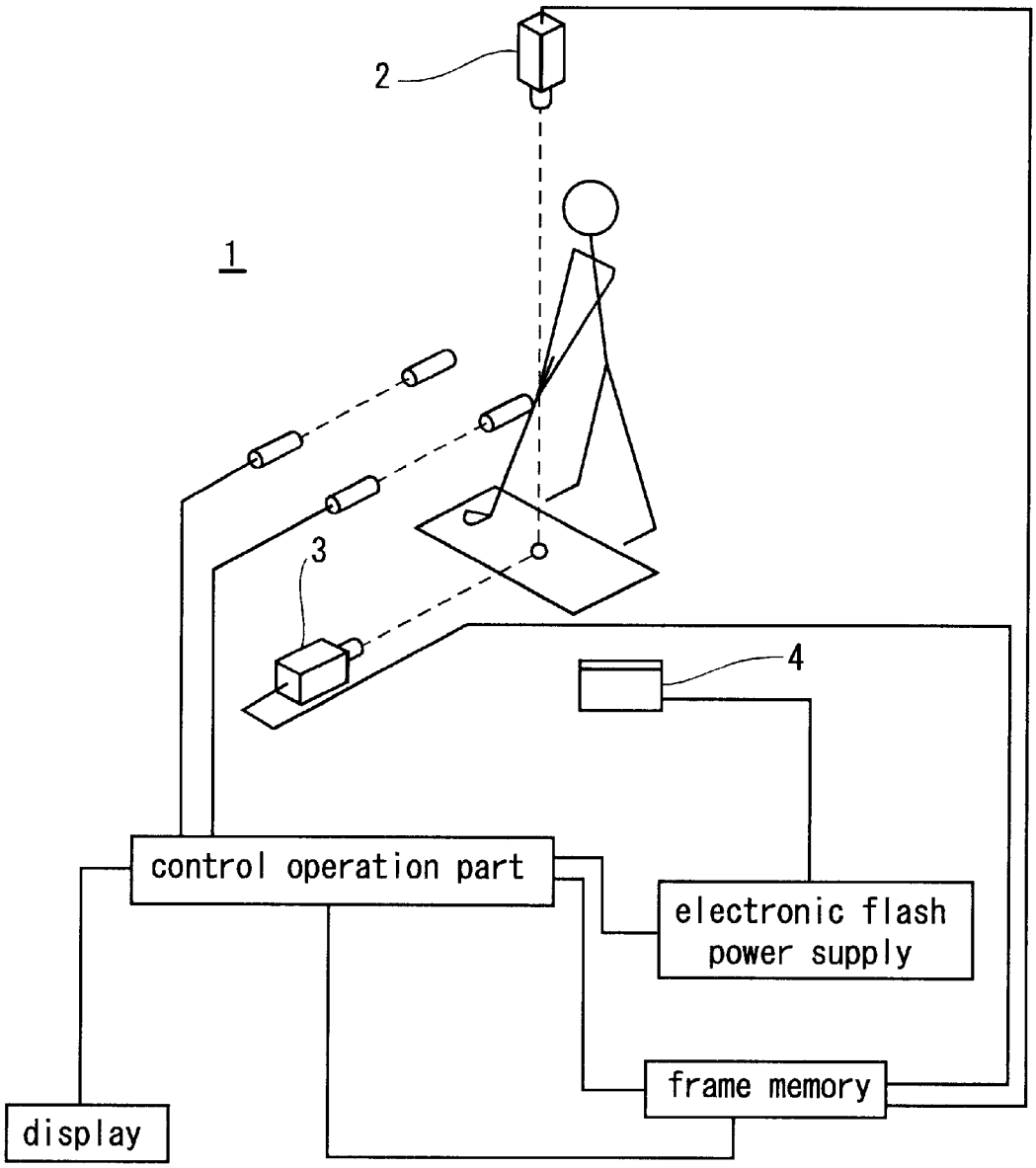
FIG. 5 is a schematic view showing a conventional measuring apparatus.
Figure 6A:
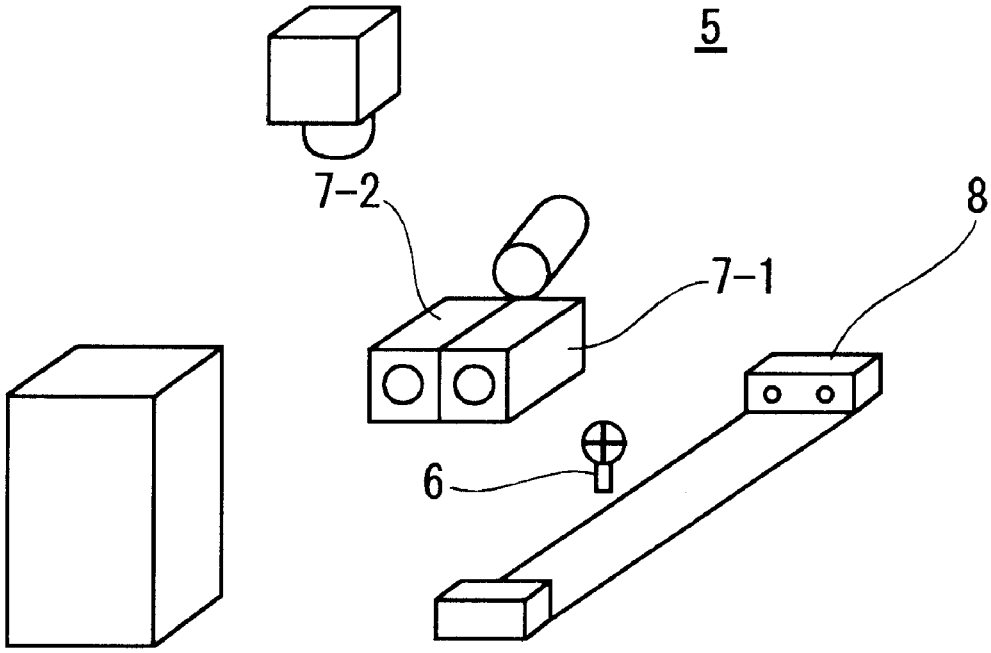
FIG. 6A is a schematic view showing another conventional measuring apparatus.
Figure 6B:
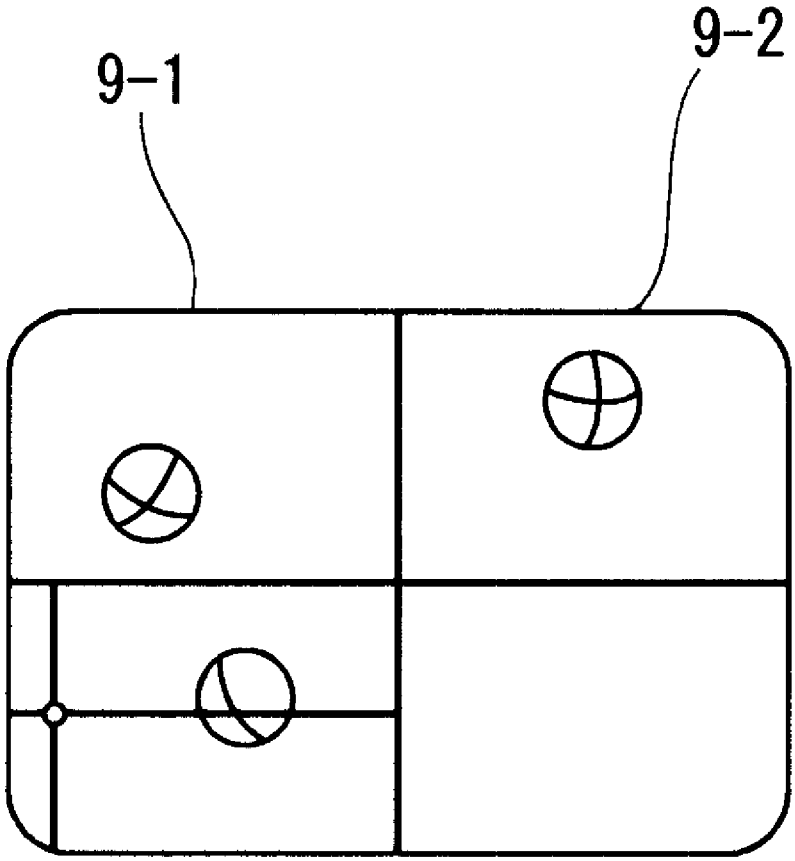
FIG. 6B shows a ball image photographed by the measuring apparatus shown in FIG. 6A.

The rotational amount of the golf ball is measured by utilizing a mark 71 (characters "ABCDE" shown in FIG. 4A), shown in FIG. 4, such as a brand or the like put on the surface 70*a* of the golf ball. The controlling/computing device 16 determines central coordinate of each of a first golf ball image 81 and a second golf ball image 82 in the frame image 80 shown in FIG. 4B. The controlling/computing device 16 computes a movement distance of each of a given point 71*a* (character A in FIG. 4B) and a given point 71*b* (character B in FIG. 4B) from a displacement of the points 71*a* and 71*b*. In consideration of the interval between the first and second opening/closing times, the controlling/computing device 16 computes the rotational amount of the golf ball with respect to the rotational axis thereof passing through its central coordinate by using a method similar to that disclosed in the present applicant's Registered Patent No.2810320.

The ball motion measuring apparatus 10 computes the head speed of a golf club G which is used as a ball-hitting means, in addition to the above-described motions of the golf ball. As described above, when the golf club G passes between the projector 19 and the receptor 20, it intercepts the first detection ray K-1 and the second detection ray K-2 The controlling/computing device 16 stores the time when the golf club G has intercepted the first detection ray K-1 and the time when the golf club G has intercepted the second detection ray K-2. The controlling/computing device 16 computes the difference between both times. Then, the controlling/computing device 16 computes the head speed of the golf club G from the relationship between the difference between both times and the interval P between the first projecting part 19*a*-1 and the second projecting part 19*a*-2.

As described above, computed numerical values are processed by the controlling/computing device 16. Thereafter, the results and the frame images are displayed on the monitor 17. Thus, it is possible to confirm results of measurement easily. The mode of the ball motion measuring apparatus of the present invention is not limited to the above-described one, but various modifications can be made. For example, the triggering sensor may be provided separately from the swinging speed measuring sensor. As the triggering sensor, it is possible to use a sound sensor detecting a hitting sound or a reflective-type sensor disposed immediately before the tee to detect interception of a hit ball.

The CCD camera and the triggering sensor provided separately from the swinging speed measuring sensor may be disposed at positions other than the above-described position to compute motions of the golf ball at times other than the time immediately after it is driven. The ball motion measuring apparatus of the present invention is applicable to measurement of the motion of a mark-applied golf ball, similarly to the conventional measuring apparatus. In addition to the golf ball, the ball motion measuring apparatus can be applied to analyze various motions of a baseball ball, a tennis ball, and the like by photographing them by the method of the present invention.

As apparent from the foregoing description, because a ball can be photographed by one CCD camera of the ball motion measuring apparatus of the present invention, it is possible to allow the ball motion measuring apparatus to be compact and lightweight. Thus, it is easy to carry the ball motion measuring apparatus and dispose the CCD camera in measuring the behavior of the ball outdoors. That is, the ball motion measuring apparatus is mobile. Further, the trigger signal allows the ball to be photographed reliably. In addition, the contrast of an image of the ball can be clear owing to flashlight emitted by the strobes synchronously with the opening/closing of the multi-shutter. Thus, it is possible to clearly photograph the contour and surface of the image of the ball and improve measurement results obtained, based on the photographed image. Furthermore, because the clear ball image eliminates the need for applying a mark to the ball to be measured. Accordingly, it is possible to reduce time and labor required to prepare for measurement.

What is claimed is:

1. A ball motion measuring apparatus comprising:

a CCD camera having a multi-shutter capable of successively opening and closing at a plurality of times at a high speed;

a triggering sensor detecting a movement of a ball-hitting means or that of a ball and outputting a trigger signal to set opening and closing times of said multi-shutter; and a controlling and computing device connected to said CCD camera and said triggering sensor and having a storing medium for an image frame and an image display means, wherein owing to a plurality of successive opening and closing of said multi-shutter caused by detection of said triggering sensor, said CCD camera photographs a plurality of ball images on a one-image frame, and said image display means displays said ball images in said one-image frame, wherein an interval between an opening and closing time and a successive opening and closing time is 1.5 to 3.0 ms, and wherein based on a plurality of images of a ball photographed in said one-image frame, said controlling and computing device determines a central coordinate of each of images of said ball and computes an actual movement distance of said ball and a flight speed of said ball from an interval between an opening and closing time of said multi-shutter and a successive opening and closing time of said multi-shutter.

2. The ball motion measuring apparatus according to claim 1, wherein strobes having a number equal to or more than the number of opening and closing times of said multi-shutter are connected to said controlling and computing device, and said strobes flash sequentially and synchronously with opening and closing times of said multi-shutter.

3. The ball motion measuring apparatus according to claim 2, wherein said controlling and computing device is connected to a swinging speed measuring sensor, for measuring a swinging speed of said ball-hitting means, having a projector having two projecting parts each emitting a detection ray and a receptor having two light-receiving parts each detecting said detection rays, and said swinging speed measuring sensor is disposed rearward from a ball-hitting position so that said controlling and computing device measures an interval between a time when said ball-hitting means intercepts one of said detection rays and a time when said ball-hitting means intercepts the other detection ray, whereby a swinging speed of said ball-hitting means is computed.

4. The ball motion measuring apparatus according to claim 3, wherein said swinging speed measuring sensor serving as said triggering sensor is horizontally located at a position, 20 mm to 40 mm rearward from said ball-hitting position, orthogonal to an imaginary straight line extending in a predetermined progress direction of said ball and outputting said trigger signal when said ball-hitting means intercepts said detection rays, and said CCD camera is horizontally located at a position, 100 mm to 300 mm forward from said ball-hitting position, orthogonal to said imaginary straight line to photograph images of said ball immediately after hitting.

5. The ball motion measuring apparatus according to claim 1, wherein based on a plurality of images of a ball photographed in said one-image frame, said controlling and computing device computes an angle of a trajectory passing through central coordinates of images of said ball with respect to a horizontal direction pre-calibrated on said one-image frame to compute a flight angle of said ball with respect to an actual horizontal line.

6. The ball motion measuring apparatus according to claim 3, wherein based on a plurality of images of a ball photographed in said one-image frame, said controlling and computing device computes an angle of a trajectory passing through central coordinates of images of said ball with respect to a horizontal direction pre-calibrated on said one-image frame to compute a flight angle of said ball with respect to an actual horizontal line.

7. The ball motion measuring apparatus according to claim 1, wherein said controlling and computing device compares a diameter of each of a plurality of images of a measuring ball in said one-image frame with a diameter of each of reference images of two or more balls pre-photographed by said CCD camera, which stored in said controlling and computing device adding each data of said balls locating at different positions with respect to an imaginary straight line extending in a predetermined progress direction of said balls to determine a distance from said imaginary straight line and compute a deflection angle of said measuring ball line with respect to said predetermined progress direction.

8. The ball motion measuring apparatus according to claim 3, wherein said controlling and computing device compares a diameter of each of a plurality of images of a measuring ball in said one-image frame with a diameter of each of reference images of two or more balls pre-photographed by said CCD camera, and stored in said controlling and computing device, and said controlling and computing device adds each data of said balls located at different positions with respect to an imaginary straight line extending in a predetermined progress direction of said balls to determine a distance from said imaginary straight line and compute a deflection angle of said measuring ball with respect to said predetermined progress direction.

9. The ball motion measuring apparatus according to claim 5, wherein said controlling and computing device compares a diameter of each of a plurality of images of a measuring ball in said one-image frame with a diameter of each of reference images of two or more balls pre-photographed by said CCD camera, and stored in said controlling and computing device, and said controlling/computing device adds each data of said balls located at different positions with respect to an imaginary straight line extending in a predetermined progress direction of said balls to determine a distance from said imaginary straight line and compute a deflection angle of said measuring ball with respect to said predetermined progress direction.

10. The ball motion measuring apparatus according to claim 1, wherein based on a plurality of images of a ball photographed in said one-image frame, said controlling and computing device determines a central coordinate of each of a plurality of images of a ball photographed in said one-image frame, said controlling and computing device determines a central coordinate of each of a plurality of images of said ball and computes an actual movement distance of a given point on said ball to compute a rotational amount of said ball on a rotational axis passing through a central coordinate of said ball by an interval between an opening and closing time of said multi-shutter and a successive opening and closing time of said multi-shutter.

11. The ball motion measuring apparatus according to claim 3, wherein based on a plurality of images of a ball photographed in said one-image frame, said controlling and computing device determines a central coordinate of each of a plurality of images of said ball and computes an actual movement distance of a given point on said ball to compute a rotational amount of said ball on a rotational axis passing through a central coordinate of said ball by an interval between an opening and closing time of said multi-shutter and a successive time of said multi-shutter.

12. The ball motion measuring apparatus according to claim 5, wherein based on a plurality of images of a ball photographed in said one-image frame, said controlling and computing device determines a central coordinate of each of a plurality of images of said ball and computes an actual movement distance of a given point on said ball to compute a rotational amount of said ball on a rotational axis passing through a central coordinate of said ball by an interval between an opening and closing time of said multi-shutter and a successive opening and closing time of said multi-shutter.

13. The ball motion measuring apparatus according to claim 7, wherein based on a plurality of images of a ball photographed in said one-image frame, said controlling and computing device determines a central coordinate of each of a plurality of images of said ball and computes an actual movement distance of a given point on said ball to compute a rotational amount of said ball on a rotational axis passing through a central coordinate of said ball by an interval between an opening/closing time of said multi-shutter and a successive opening/closing time of said multi-shutter.

* * * * *